US011346087B2

(12) United States Patent
Betz et al.

(10) Patent No.: US 11,346,087 B2
(45) Date of Patent: May 31, 2022

(54) NANOPATTERNED SURFACES AND METHODS FOR ACCELERATED FREEZING AND LIQUID RECOVERY

(71) Applicant: Kansas State University Research Foundation, Manhattan, KS (US)

(72) Inventors: Amy Betz, Manhattan, KS (US); Melanie Derby, Manhattan, KS (US)

(73) Assignee: Kansas State University Research Foundation, Manhattan, KS (US)

( * ) Notice: Subject to any disclaimer, the term of this patent is extended or adjusted under 35 U.S.C. 154(b) by 156 days.

(21) Appl. No.: 16/301,236

(22) PCT Filed: May 12, 2017

(86) PCT No.: PCT/US2017/032495

§ 371 (c)(1),
(2) Date: Nov. 13, 2018

(87) PCT Pub. No.: WO2017/197318

PCT Pub. Date: Nov. 16, 2017

(65) Prior Publication Data

US 2019/0292754 A1 Sep. 26, 2019

Related U.S. Application Data

(60) Provisional application No. 62/336,156, filed on May 13, 2016.

(51) Int. Cl.
*E03B 3/28* (2006.01)
*F28F 13/18* (2006.01)
(Continued)

(52) U.S. Cl.
CPC ..... *E03B 3/28* (2013.01); *F25B 39/02* (2013.01); *F25C 1/00* (2013.01); *F28F 13/187* (2013.01)

(58) Field of Classification Search
CPC ..... F28F 13/187; F28F 13/185; F28F 13/02; F28F 2255/20; E03B 3/28; B32B 3/085
See application file for complete search history.

(56) References Cited

U.S. PATENT DOCUMENTS 4,249,391 A 2/1981 Taylor
7,459,197 B2 * 12/2008 Aizenberg ..... B05D 5/04 427/256

(Continued)

FOREIGN PATENT DOCUMENTS

WO 2016058525 4/2016

OTHER PUBLICATIONS

The International Search Report and Written Opinion dated Aug. 10, 2017, in PCT/US2017/032495, filed May 12, 2017.

(Continued)

*Primary Examiner* — Lionel Nouketcha
(74) *Attorney, Agent, or Firm* — Hovey Williams LLP

(57) ABSTRACT

Inventive surfaces, and methods of using the same, are provided that exhibit improved water collection and frost formation properties over prior art surfaces. The inventive surfaces have a plurality of nanosized recessed areas formed therein. The geometries and patterns of the recessed areas are particularly designed to discourage water droplet coalescence on the surfaces. Due to these designs, the surfaces are capable of forming and maintaining smaller, as well as asymmetrical, droplets on the surfaces. As a result, a greater surface area of the inventive surfaces can be covered by water droplets, thereby increasing water recovery. In addition, the smaller, asymmetrical droplets lead to desirable frost layer characteristics under non-cryogenic freezing conditions.

18 Claims, 17 Drawing Sheets

(51) Int. Cl.
*F25B 39/02* (2006.01)
*F25C 1/00* (2006.01)

(56) References Cited

U.S. PATENT DOCUMENTS 8,865,297 B2 * 10/2014 Xiao ..... B08B 17/065 428/141
2005/0069458 A1 * 3/2005 Hodes ..... B82Y 20/00 422/400
2007/0028588 A1 * 2/2007 Varanasi ..... F28F 13/187 165/133
2012/0051489 A1 * 3/2012 Varanasi ..... F28F 13/182 376/424
2013/0025831 A1 * 1/2013 Attinger ..... H01L 23/473 165/104.27
2013/0227972 A1 * 9/2013 Hatton ..... B08B 17/065 62/71
2014/0000857 A1 * 1/2014 King ..... F28F 13/04 165/185
2014/0238646 A1 * 8/2014 Enright ..... H01L 23/427 165/104.21
2014/0272301 A1 * 9/2014 Gross ..... C09D 5/00 428/149

OTHER PUBLICATIONS

Rahman, M. A. "Experimental Study on Condensation, Frost Formation and Condensate Retention on Microgrooved and Plain Brass Surfaces Under Natural Convection Condition," 8th International Convention on Heat Transfer, Fluid Mechanics and Thermodynamics, Jun. 26-Jul. 1, 2011, Pointe Aux Piments, Mauritius.

* cited by examiner

NANOPATTERNED SURFACES AND METHODS FOR ACCELERATED FREEZING AND LIQUID RECOVERY

CROSS-REFERENCE TO RELATED APPLICATIONS

The present application is the National Stage entry under 35 U.S.C. 371 of International Patent Application No. PCT/US2017/032495, filed May 12, 2017, which claims the priority benefit of U.S. Provisional Patent Application Ser. No. 62/336,156, filed May 13, 2016, entitled NANOPOROUS SURFACES AND METHODS FOR ACCELERATED FREEZING AND LIQUID RECOVERY, each of which is incorporated by reference in its entirety herein.

STATEMENT REGARDING FEDERALLY SPONSORED RESEARCH

This invention was made with government support under Grant No. 1448270 awarded by the National Science Foundation. The government has certain rights in the invention.

BACKGROUND OF THE INVENTION

Field of the Invention

The present invention is generally directed to nanopatterned surfaces exhibiting performance properties particularly suited for accelerated frost formation and increased water recovery.

Description of the Prior Art

There is currently significant research on improving fog harvesting and water collection. For example, mesh screens have been employed to recover water from fog in dry environments and from steam evaporate in power plant cooling towers. However, water recovery using these prior art methods is still largely inefficient, and much of the water in these applications remains unrecovered. Therefore, there is a need for ways to increase water recovery.

Moreover, the effects of droplet coalescence on freezing have not been widely investigated. Some previous studies have shown that surfaces designed to increase droplet coalescence can help to prevent frost formation. However, under certain temperatures and relative humidity, frost formation is inevitable. The formation and growth of frost can negatively impact the efficiency and operation of refrigeration and air-conditioning systems as well as air-cooled condensers in power generation. Therefore, there is a need for ways to mitigate the deleterious effects of frost formation on surfaces.

SUMMARY OF THE INVENTION

In one embodiment of the present invention, there is provided a surface for enhancing the condensation of a vapor and/or accelerating freezing of a liquid on the surface. The surface comprises a substrate adapted to condense a vapor and cause a plurality of asymmetrically-shaped droplets to form thereon. The substrate comprises a plurality of recessed areas preferably comprising regions in which material making up said substrate has been removed. The plurality of recessed areas have an average longest lateral dimension of about 100 nm to about 10 μm and an average depth of about 150 nm to about 30 μm. The recessed areas are adapted to restrict the mobility of the droplets upon the surface and inhibit formation of symmetrical droplets through droplet coalescence upon the surface.

In another embodiment, there is provided a method of recovering water from a humid vapor. The method comprises contacting the humid vapor with a surface having a surface temperature less than the dew point of the humid vapor. The contacting causes one or more water droplets to form on the surface. The surface comprises a plurality of recessed areas having an average longest lateral dimension of about 100 nm to about 10 μm and an average depth of about 150 nm to about 30 μm.

In yet another embodiment, there is provided a method of forming frost on a surface. The method comprises contacting the surface with humid air, thereby causing one or more water droplets to form on the surface. The surface has a surface temperature less than the frost point of the air. The method further comprises freezing the droplets to form a frost layer on the surface. The surface comprises a plurality of recessed areas having an average longest lateral dimension of about 100 nm to about 10 μm and an average depth of about 150 nm to about 30 μm.

In still another embodiment, there is provided a heat exchange system. The system comprises one or more conduits configured to conduct a heat-exchange fluid therethrough. The one or more conduits have an inner surface configured to contact the heat-exchange fluid and an outer surface comprising a plurality of recessed areas having an average longest lateral dimension of about 100 nm to about 10 μm and an average depth of about 150 nm to about 30 μm.

In another embodiment, there is provided a cooling tower. The cooling tower comprises one or more evaporate condensing units positioned to contact at least a portion of an evaporate. The one or more condensing units have one or more outer surfaces comprising a plurality of recessed areas having an average longest lateral dimension of about 100 nm to about 10 μm and an average depth of about 150 nm to about 30 μm.

BRIEF DESCRIPTION OF THE DRAWINGS

FIG. 13A shows a clean silicon wafer; FIG. 13B shows a photosensitive polymer spun onto the wafer and crosslinked; FIG. 13C shows the photosensitive polymer selectively exposed to light, creating regions where the polymer was no longer crosslinked; and FIG. 13D shows the shows the development of the exposed regions, thereby creating regularly patterned nanopores (FIG. 13);

FIGS. 17A and 17B are images showing the formation of cubic ice crystals on a nanoporous surface in accordance with the present invention, wherein FIG. 17A shows a wide view of crystal structures on the nanoporous surface, and FIG. 17B shows a single cubic ice crystal;

DETAILED DESCRIPTION OF THE PREFERRED EMBODIMENTS

Figure 1:
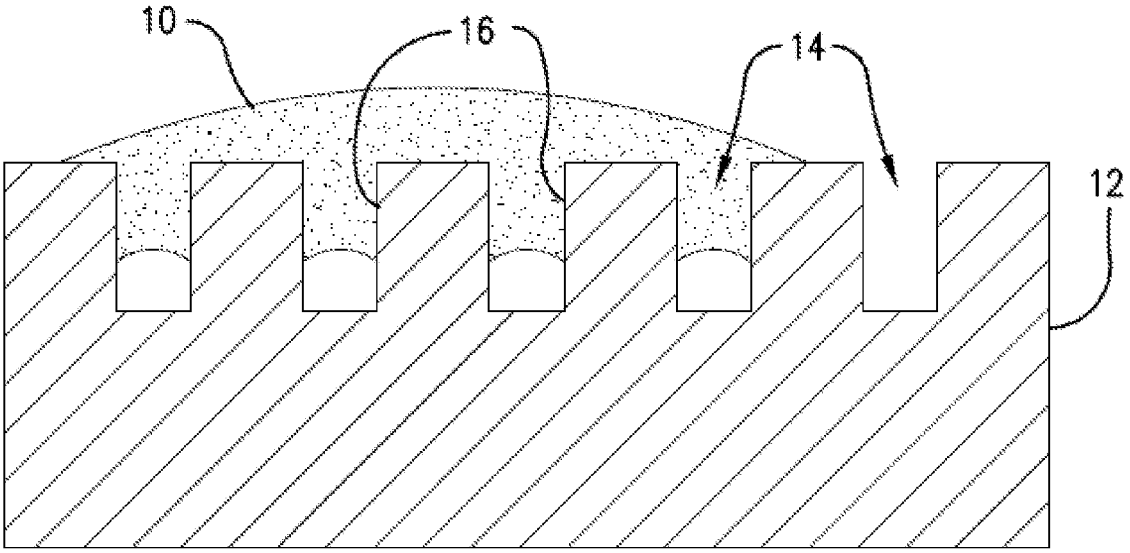
FIG. 1 is a profile, schematic depiction of an embodiment of the inventive nanopatterned surfaces having a droplet pinned to multiple pores.
Figure 2:
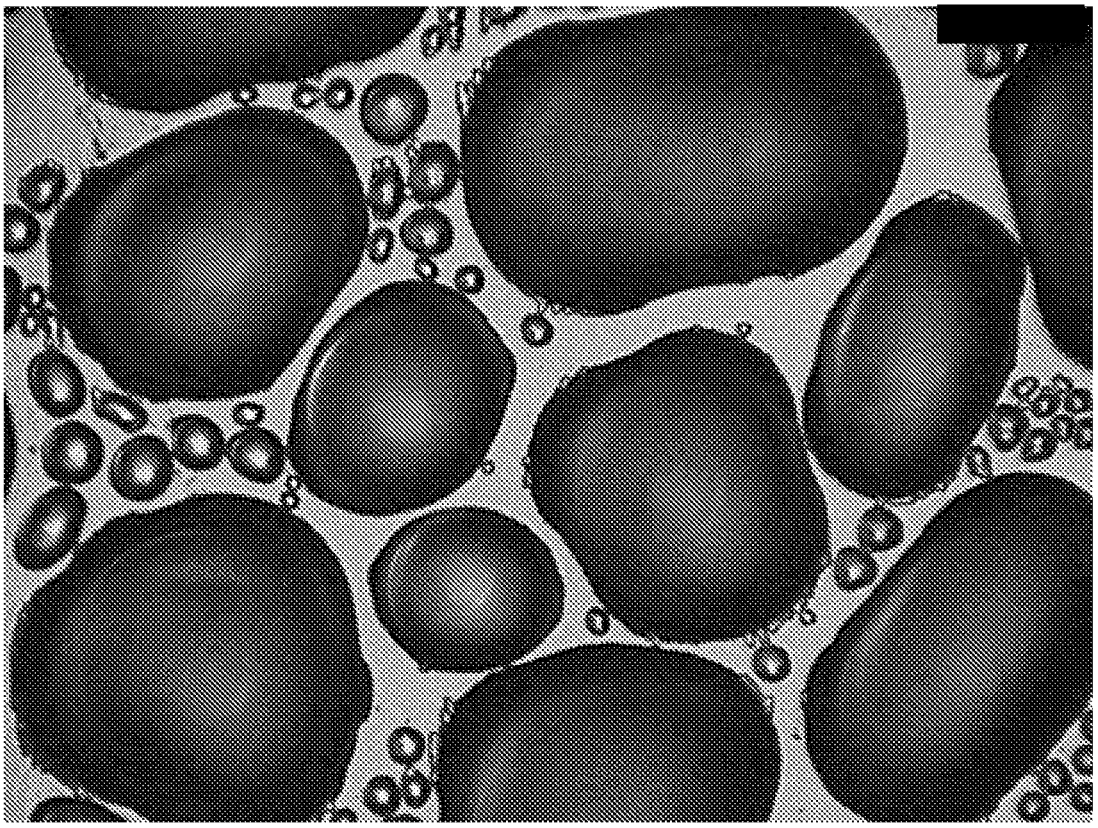
FIG. 2 is a microscopic image of the asymmetrical, condensed droplets formed on a nanoporous surface, wherein the image width is 750 μm.
Figure 3:
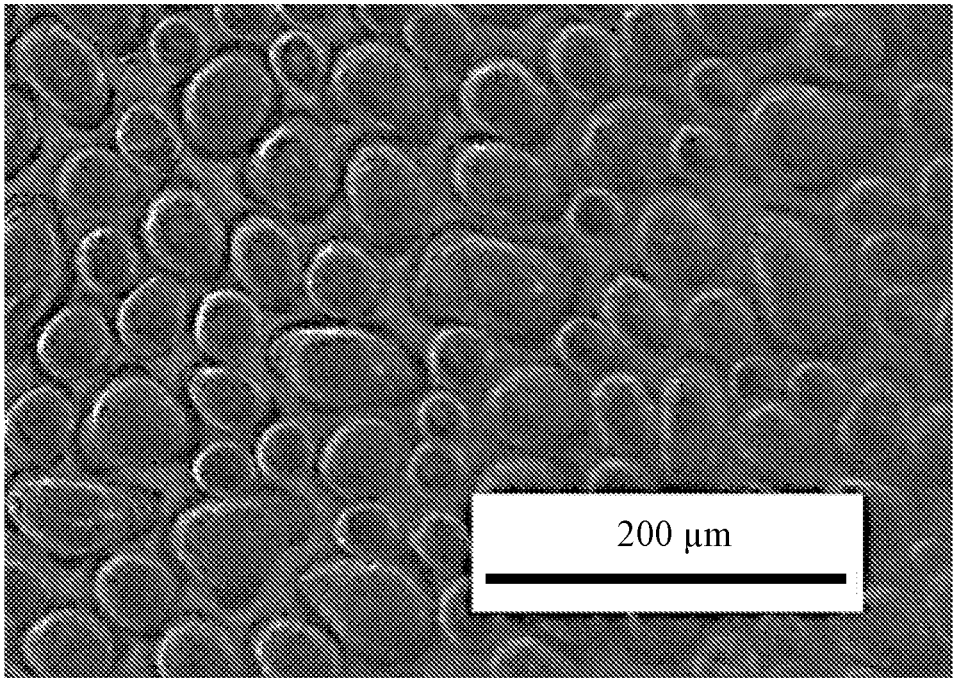
FIG. 3 is a microscopic image of frozen water droplets formed on a nanoporous surface.
Figure 4:
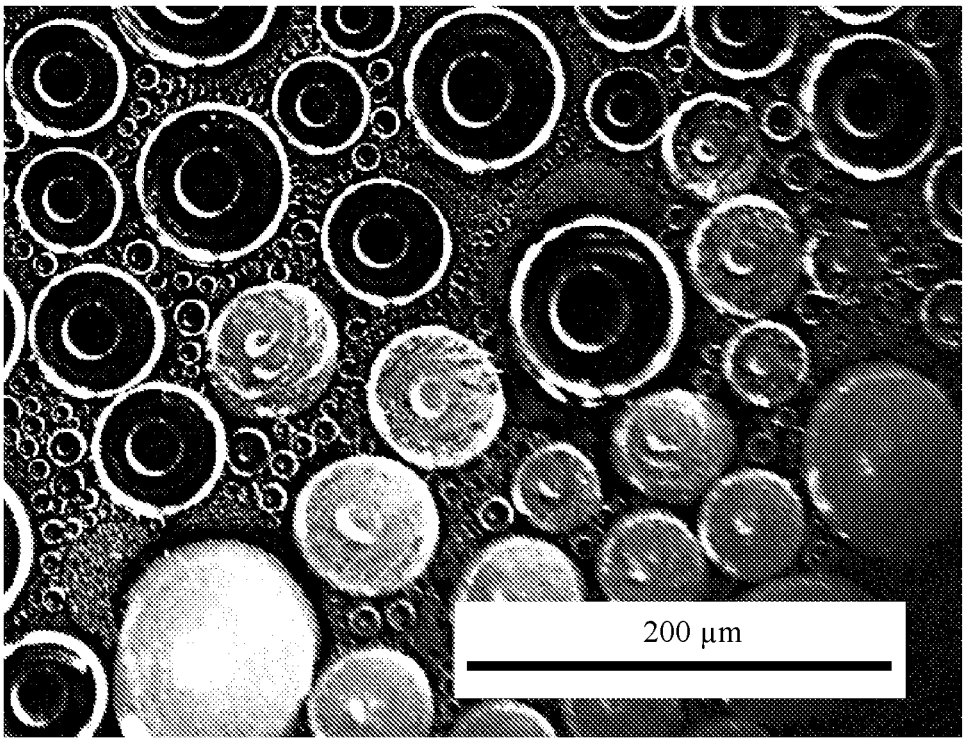
FIG. 4 is a microscopic image of frozen water droplets formed on a hydrophilic surfaces, wherein the frozen droplets show the typical spherical-capped shape.

In order to better understand the advantages of the inventive surfaces and methods, the governing scientific principles are explained in more detail below. When surface temperature is below the air dew point temperature, water droplets condense on the surface at atmospheric pressures. Plain (flat) surfaces and microstructured surfaces of the prior art will maintain generally symmetrical, capped-shaped droplets thereon, even when the surfaces are hydrophilic, hydrophobic, and combined hydrophobic/hydrophilic (biphilic). Water typically forms symmetrical, and spherical or semispherical droplets on such surfaces in order to minimize the surface energy (the spherical shape is the preferred energy state). However, condensed droplets on the inventive nanopatterned surfaces can be asymmetrical and non-spherical. This is because the nanopatterned surfaces generally comprise a plurality of recessed areas formed therein, which may comprise a plurality of pores (holes) formed into the surface or the interstitial spaces between a plurality of structures (e.g., pillar structures) extending from the surface. The energy required to overcome the capillary pressure to remove the water from the recessed areas is greater than the increase in surface energy from the non-spherical shape. Thus, the nanopatterned surfaces of the present invention effectively "pin" the condensed droplets on the surfaces, without forming the usual, symmetrical droplet shape. This pinning effect causes the droplets formed on the surfaces to have substantially different shape than droplets deposited on plain (flat) or microstructured surfaces. FIG. 1 is a profile view showing a droplet 10 being pinned to an inner portion 16 of the plurality of pores 14 formed in the surface substrate 12, according to one embodiment of the present invention. A microscope image of exemplary asymmetrical, condensed droplets is shown in FIG. 2. The differences in droplet shape on the nanopatterned surfaces compared to prior art surfaces leads to differences in freeze behavior of the droplets. As shown in FIGS. 3 and 4, the nanopatterned surface provides smaller, deformed droplets (FIG. 3) as compared to the standard, symmetrical droplets formed on a plain, flat hydrophilic surface (FIG. 4) at similar freezing conditions. In order to pin the droplets onto surfaces, create and maintain asymmetrical droplet shapes, and alter freezing behavior of the droplets, certain design parameters should be considered. For example, the pore diameter (in nanoporous surfaces) or the distance between pillars (in nanopillared surfaces) should be within the range of active nucleation site sizes to ensure that the water condenses in the interior of the pore or between pillars. In addition, the pore diameter or distance between pillars should be smaller than the initial nuclei so that condensed water fills the pore opening or space between pillars and the droplet spans over multiple pores or pillars. This will also ensure that capillary pressure is significant. Active nucleation site droplet sizes (diameters) range from about 100 nm to about 30 μm, depending on conditions. Initial water nuclei are typically about 1 μm to about 10 μm. Therefore, preferred pore diameters or pillar spacings are chosen based on these values.

With respect to porous surfaces, in order for the pores to pin the droplets to the surface and prevent coalescence, the energy required to overcome the capillary pressure ($E_{cap}$) must be greater than the surface energy reduction by coalescing droplets, Eq. 1.

$$E_{cap} \geq SA_{red} \quad \text{Eq. 1}$$

The total energy required to overcome the capillary pressure will be the capillary pressure ($P_{cap}$) multiplied by the volume (V) of water in a pore, multiplied by the pore density (n') and the contact area of a drop ($A_c$), Eq. 2.

$$E_{cap} = P_{cap} \cdot V \cdot n' \cdot A_c \quad \text{Eq. 2}$$

The surface area reduction from two coalescing droplets assumes that the droplets are spherical caps and that the two coalescing droplets are the same size ($R_{dl}$). With these two assumptions the reduction in surface energy depends on the contact angle (θ) and the droplet radius, Eq. 3.

$$SA_{red} = 2^{1/3}\pi \cdot (R_{dl})^2 \cdot (1 + ((1 - \cos\theta)/\sin\theta)^2) \quad \text{Eq. 3}$$

Substituting in parameters for the equations above, the capillary energy depends on the surface tension of water in air (σ), the radius of the pores (r), the height (i.e., depth) of the pores (h), and the density of the pores, Eq.4.

$$4\pi \cdot \sigma \cdot \cos\theta \cdot r \cdot h \cdot n' \geq 2^{1/3}(1 + ((1 - \cos\theta)/\sin\theta)^2) \quad \text{Eq. 4}$$

The pore density was assumed to be a function of the pore radius with a pitch of 4r, Eq. 5.

$$n'=1/(16r^2) \quad \text{Eq. 5}$$

The equation can be simplified and it is found that the required radius is a function of surface tension (σ), the contact angle (θ), and the height (h) or the pores, Eq. 6.

$$r \geq [(1/4)\pi\cdot\sigma\cdot\cos\theta\cdot h]/[2^{1/3}(1+((1-\cos\theta)/\sin\theta)^2)] \quad \text{Eq. 6}$$

Figure 5:
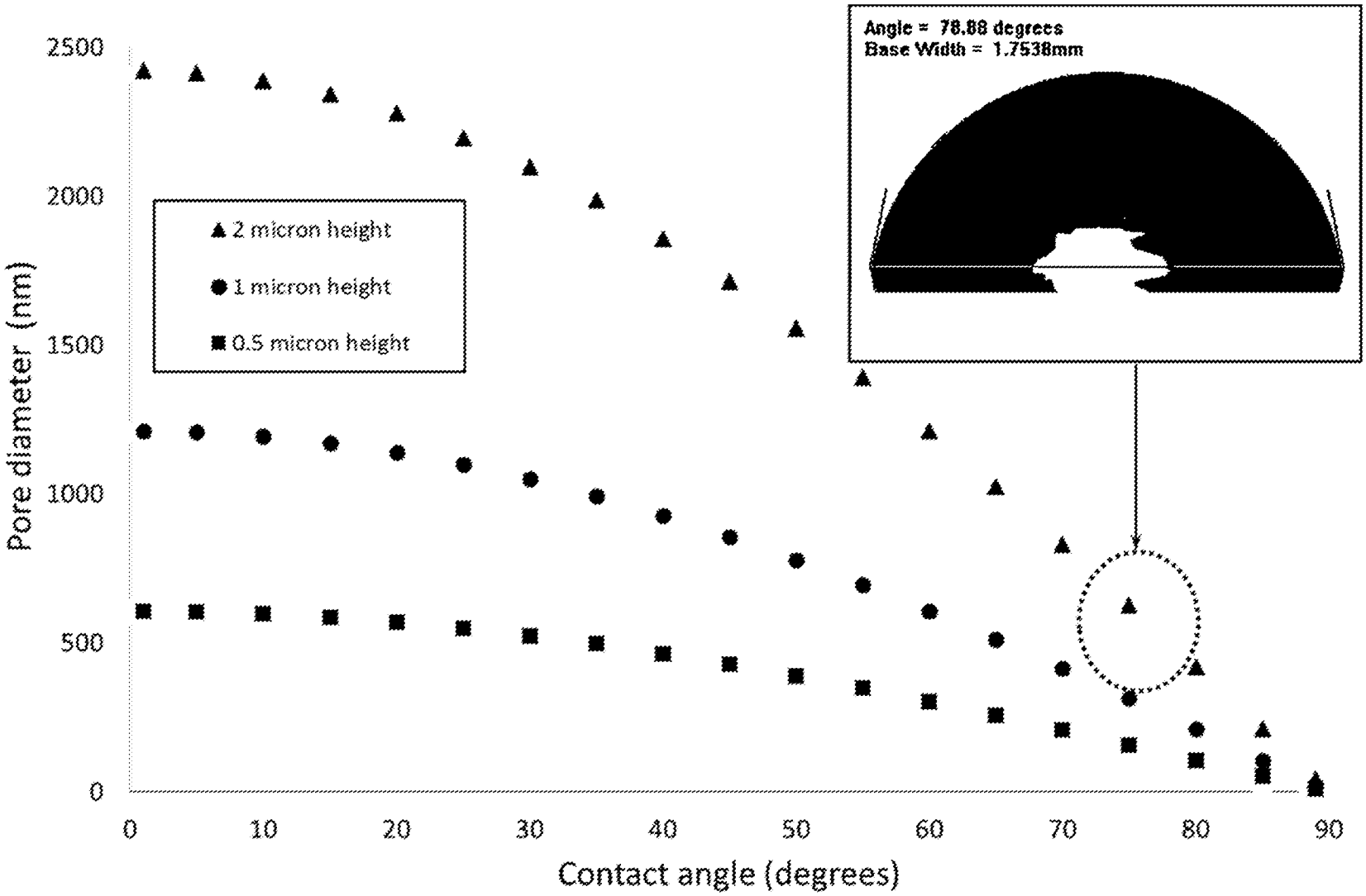
FIG. 5 a graph plotting the diameter required to pin the droplets and reduce coalescence on surfaces with varying pore sizes, and the insert shows a close-up image of an exemplary droplet formed on a surface having a contact angle of 78.88 degrees.

Assuming water as the fluid condensing on the surface, FIG. 5 is a graph plotting the pore diameter required to pin the droplets and reduce coalescence. This analysis also shows that when the fluid is water, it is preferred that the surface be hydrophilic (i.e., the contact angle between the surface and the water droplet should be equal to or less than 90°) in order to achieve the strongest pinning effect on the droplets.

When surface temperatures fall below the freezing point, the water droplets can freeze to form ice crystals (frost) on the surface. There are many different phases and crystalline structures of ice. On earth, the most common phase is ice I. Ice I typically has a hexagonal crystalline structure, denoted by $I_h$. This is the reason snowflakes have six sides, and the hexagon can be observed in snowflakes and frost formations. Cubic ice is a metastable form of ice I, denoted by $I_c$. It will form at atmospheric pressure but usually requires temperatures below 170 K. Other polymorphs of ice can be formed by increasing the pressure or decreasing the temperature. For example, ice I will transition to ice II at pressures of 2130 bar (213 MPa) and 239 K. There are also three forms of vitreous or amorphous ice, low-density, high-density, and very-high-density. Amorphous ice typically requires temperatures below 110 K to form and is commonly observed in comets and icy moons. At atmospheric pressure, if a surface temperature is below the freezing point, water will heterogeneously nucleate and subsequently freeze, forming ice nuclei. From these nuclei, one-dimensional crystalline structures will grow upwards from the ice nuclei. Under most conditions, dendrites will form and a three dimensional structure will emerge.

Figure 6:
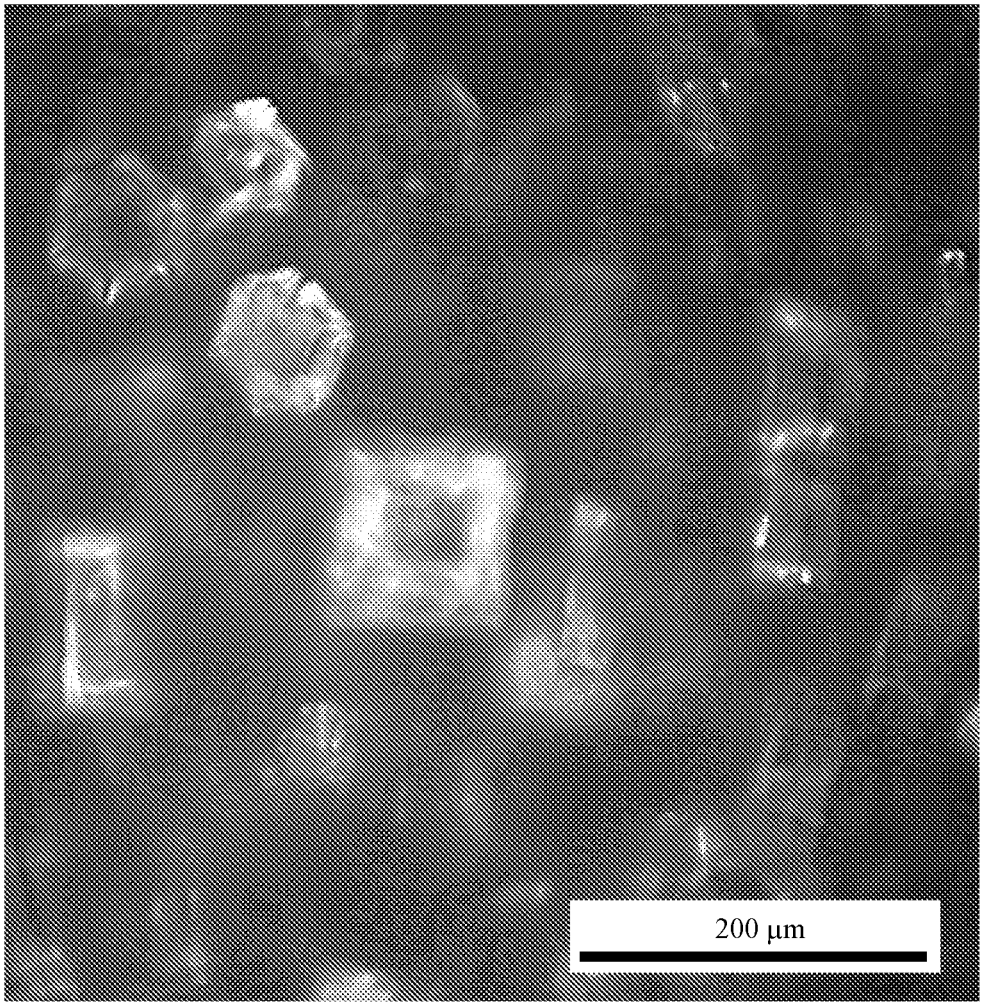
FIG. 6 is a microscopic image showing hexagonal and cubic ice structures formed on a nanoporous surface under non-cryogenic freezing conditions.
Figure 7:
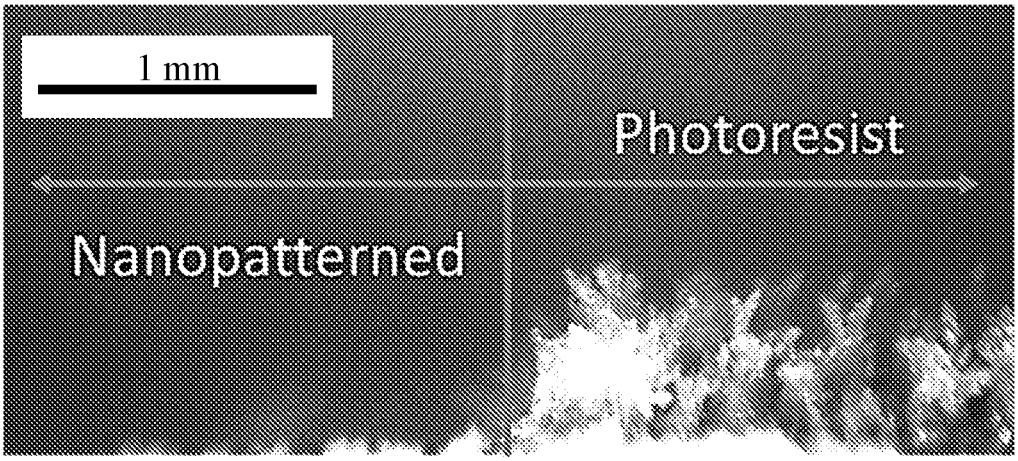
FIG. 7 is an image showing the differences in thickness of frost formed on an inventive nanoporous (nanopatterned) surface as compared to a plain, flat (photoresist) surface.

The pinning of the droplets due to the inventive surfaces has two important effects on freezing behavior. First, it decreases freezing time (i.e., accelerated frost formation). Second, it can form different structures of ice on the surface as compared to prior art surfaces. By pinning droplets, the nanoporous or nanopillared surfaces suppress coalescence, which leads to the accelerated freezing. The accelerated freezing changes the droplet freezing dynamics, compared to droplet freezing on prior art surfaces, and creates conditions for the formation of amorphous ice and cubic ice crystals. While polymorphs of ice typically require pressures in excess of 1 GPa or temperatures below 170 K to form, the surfaces in accordance with the present invention are capable of forming amorphous and cubic ice at lower pressures (e.g., atmospheric pressure) and higher surface temperatures (e.g., around 265 K), as shown in FIG. 6. The freezing behavior and frost structure achieved by the inventive surfaces provides for improved performance properties related to the thermal conductivity, density, and final height (thickness) of the frost layer formed on the surfaces. For example, the thickness difference of frost formed on an inventive surface as compared to a plain photoresist surface is shown in FIG. 7.

According to the principles described above, embodiments of the present invention are directed to nanopatterned surfaces, which are particularly suitable for applications where controlled frost formation or water collection is desired. The surfaces comprise a plurality recessed areas formed therein. In certain embodiments, the plurality of recessed areas comprise a plurality of pores formed in the substrate. In certain other embodiments, the plurality of recessed areas comprise the interstitial space between a plurality of structures (e.g., pillar structures) formed on the substrate. The plurality of recessed areas may be discrete or contiguous. Regardless the embodiment, the plurality of recessed areas generally have an average longest lateral dimension of about 100 nm to about 10 μm, preferably about 250 nm to about 5 μm, more preferably about 400 nm to about 2 μm, and most preferably about 500 nm to about 1 μm. As used herein, the "longest lateral dimension" refers to the greatest distance between two walls defining a recessed area on the inventive surfaces. For example, when the recessed area is a circular pore, the longest lateral dimension is the pore diameter ("D" in FIG. 19). When the recessed area is the interstitial space between pillars formed on a surface, the longest lateral dimension is the greatest distance between adjacent pillars ("d" in FIG. 20). Thus, the "average longest lateral dimension" refers to the mean of the longest lateral dimensions of the plurality of recessed areas on the surface. In certain other embodiments, the plurality of recessed areas have an average longest lateral dimension greater than or equal to about 10 μm, for example, from about 10 μm to about 30 μm, and preferably about 15 μm to about 25 μm. The recessed areas generally have a depth of about 150 nm to about 30 μm. Therefore, in preferred embodiments, the plurality of recessed areas have an average depth of about 150 nm to about 30 μm, preferably about 300 nm to about 20 μm, more preferably about 500 nm to about 10 μm, and most preferably about 750 nm to about 5 μm. In certain preferred embodiments, the plurality of recessed areas have an average depth of at least about 1 μm.

Figure 19:
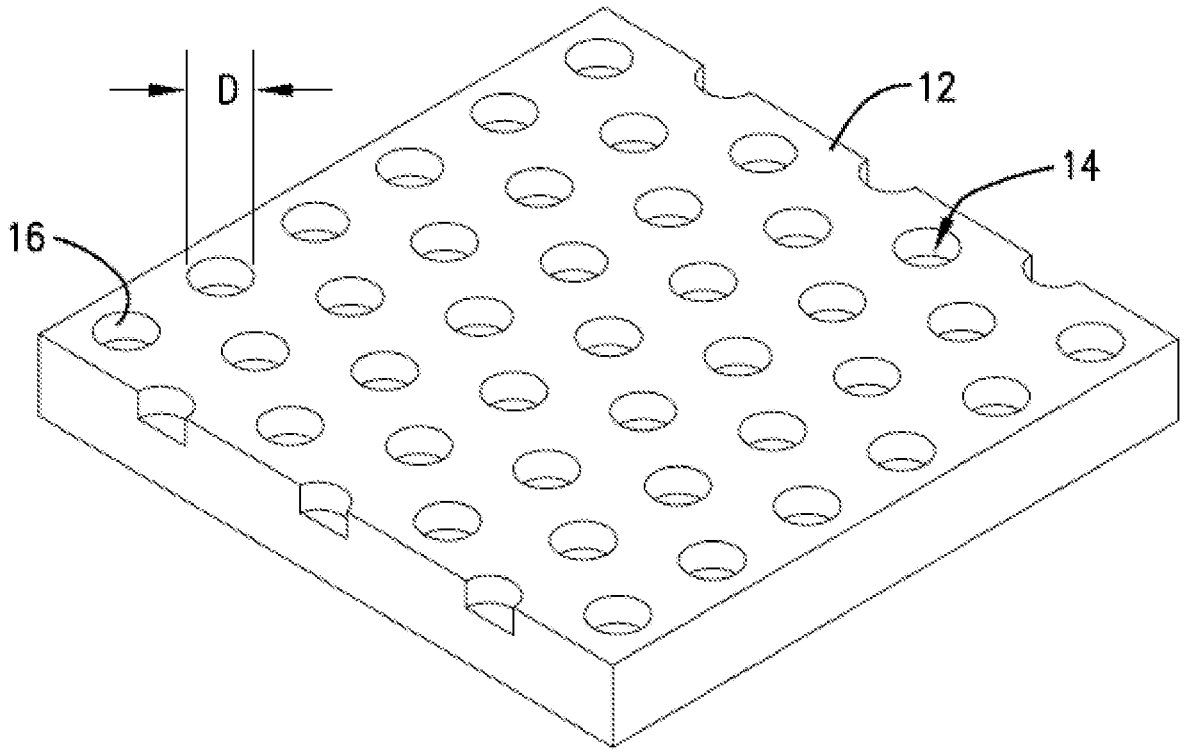
FIG. 19 is a prospective view of a nanoporous surface in accordance with embodiments of the present invention.

In certain preferred embodiments, the plurality of recessed areas are discrete pores, such that each recessed area is generally not interconnected with another recessed area on the surface (see FIG. 19). However, in certain other embodiments, it is not required that the pores be discrete on the surface, and thus it is within the scope of the present invention that the surface comprise a continuous pattern of pores (i.e., at least two pores being connected by areas in which material has been removed from the surface or through overlapping pore margins). The number of pores formed in the surface substrate per square millimeter of surface area (i.e., the pore density) may vary, depending on the particular application and environmental conditions surrounding the surface. However, in certain embodiments, the plurality of pores may be formed in the surface substrate at a pore density of about 10,000 to about 1,000,000 pores/$mm^2$, preferably about 50,000 to about 750,000 pores/$mm^2$, more preferably about 100,000 to about 500,000 pores/$mm^2$, and most preferably about 350,000 pores/$mm^2$. The distance (i.e., pitch) between the pores centers on the surface may also vary, depending on the particular application and environmental conditions surrounding the surface. In addition, if the pitch is too small, the pores may undesirably trap air or increase nucleation. If the pitch is too large, droplets may condense between pores and not be pinned by the pores. Typically, the preferred pitch for any given application will also depend on the pore diameter. Therefore, in certain embodiments, the plurality of pores have an average pitch to diameter ratio of about 1 to about 20, preferably about 1.5 to about 15, and more preferably about 1 to about 10.

Figure 8:
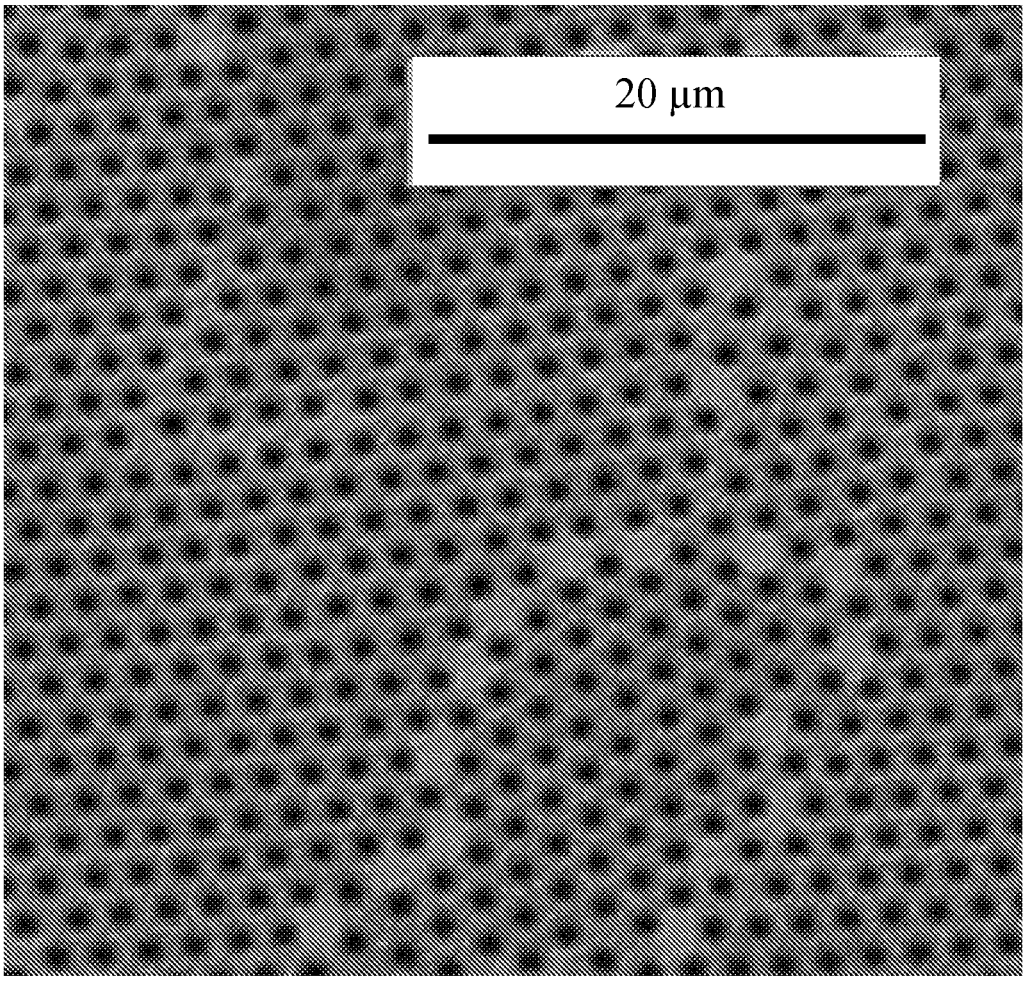
FIG. 8 is a microscopic image of a nanoporous surface in accordance with the present invention, wherein the light areas are a photopolymer layer and the dark areas are the pores.
Figure 9:
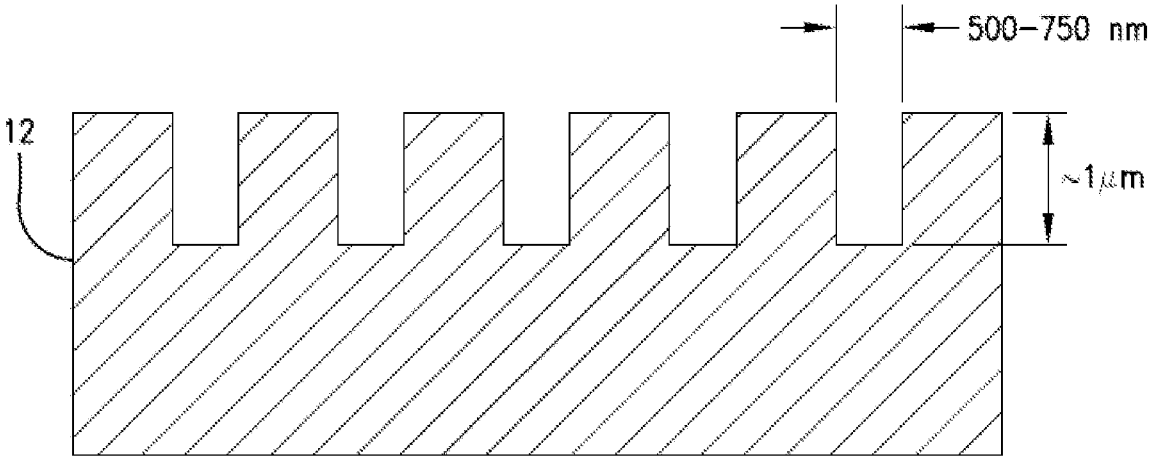
FIG. 9 is a schematic profile view showing the approximate dimensions of the pores on the surface shown in FIG. 8.

The pores may be formed into a variety of geometries, including but not limited to circular (cylindrical) or polygonal (polygonal prisms). Regardless of the pore geometry, as used herein, the pore diameter as discussed above refers to the distance across the pore opening as taken across its largest dimension. As described above, an important parameter for the design of the pores is the aspect ratio (i.e., the ratio of pore depth to pore diameter). Therefore, in particularly preferred embodiments, the plurality of pores have an average aspect ratio of greater than about 1, preferably greater than about 1.25, and more preferably greater than about 1.5. An image of an exemplary nanoporous surface in accordance with the present invention is shown in FIG. 8, with a drawing providing the approximate pore dimensions shown in FIG. 9.

Figure 20:
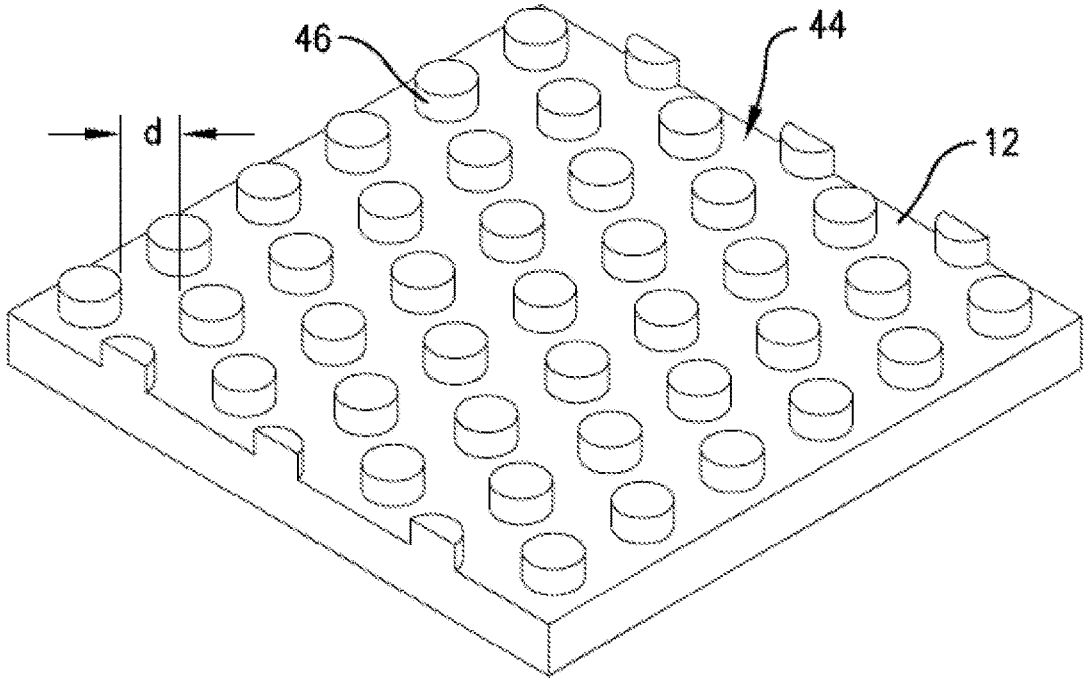
FIG. 20 is a prospective view of a nanopillared surface in accordance with embodiments of the present invention.

Another preferred embodiment is shown in FIG. 20, in which the plurality of recessed areas comprise the interstitial space 44 between a plurality of pillar structures 46 formed on a surface of substrate 12. In certain such embodiments, each of the plurality of pillar structures comprises a cylinder. Most commonly, the cylinders are circular cylinders, but it is within the scope of the present invention for the cylinders to comprise other geometries including prism structures (i.e., a rectangular prism, a triangular prism). The plurality of cylindrical pillars may have an average diameter of about 100 nm to about 30 μm, preferably about 500 nm to about 10 um, and more preferably about 700 nm to about 1 um. Preferably, the spacing between the plurality of pillars is selected such that the interstitial space between pillars acts similarly to the pores described above. In certain embodiments, the pillars are spaced such that the average distance between adjacent pillars is about 10 nm to about 10 um, preferably about 50 nm to about 5 um, and more preferably about 100 nm to about 3 um. The pillars may be formed of solid material or hollow, which will be determined by the method of manufacture.

Surfaces in accordance with the present invention can be formed from a variety of materials and by a variety of methods, so long as the material(s) chosen are amenable to formation of the recessed areas and with the desired degree of wettability. As used herein, the term "wettability" refers to the tendency of one fluid (e.g., water) to spread on, or adhere to, a solid surface in the presence of other immiscible fluids (e.g., air). Surface wettability is defined by the contact angle of the fluid with the solid surface. As noted above, the contact angle of the surface with a water droplet should preferably be less than or equal to 90° to achieve the strongest pinning effect, and thus the materials used to form the surfaces are preferably selected to result in a hydrophilic surface. In certain preferred embodiments, the inventive surfaces will have a contact angle with water of about 30° to 90°, preferably about 50° to about 85°, and more preferably about 70° to about 80°. The surfaces may comprise a substrate comprising a material selected from the group consisting of metals (and alloys), polymers, ceramics, composites, and mixtures thereof. In certain embodiments, the substrate comprises one or more layers deposited on a base material. Exemplary layers include, but are not limited to, silica (silicon dioxide) layers, photosensitive polymer layers, and other polymer or resinous coatings. In certain embodiments, the base material is silicon-based. Regardless of the materials used, in certain preferred embodiments the upper-most layer (or substrate, if no layers are present) of the surface is generally smooth, aside from the recessed areas formed therein, such that the top of the surface lies generally within the same plane. In certain preferred embodiments, the inventive surfaces comprise entirely hydrophilic materials. However, it is also within the scope of the present invention that the surfaces comprise materials which form biphilic surfaces, wherein an inner portion of the recessed areas is hydrophilic and the top surface is hydrophobic, as well as hydrophobic surfaces.

The recessed areas can be formed on the inventive surfaces in a variety of methods. Generally, the recessed areas comprise regions in which material making up the substrate has been removed. In certain embodiments, the recessed areas may be formed using photolithographic techniques, for example, by forming one or more photosensitive layers on a substrate and selectively developing and/or etching the layers to form nanostructures (e.g., pores or pillars) in the layers. However, the recessed areas may be formed by any other suitable manufacturing method, such as dry etching, laser etching, or combinations of lithography and etching techniques. The recessed areas may be formed directly into the surface substrate and/or into one or more optional layers formed on the surface substrate.

Nanopatterned surfaces of the present invention are capable of forming asymmetrical droplets thereon due to the pinning effect at the surface-droplet interface. In certain embodiments, for example, contacting the inventive surface with a humid vapor causes droplets to form on the surface due to water vapor or suspended droplets present in the humid vapor. Because of the principles discussed above, the water droplets formed on the surface remain pinned in place (to the pores or pillars) on the surface. Therefore, the recessed areas have two important effects on the droplets formed on the inventive surfaces. First, the recessed areas provide a favorable point on the surface for new droplets to nucleate. Second, the recessed areas restrict the mobility of the droplets upon the surface and inhibit formation of symmetrical droplets through coalescence on the surface.

In certain preferred embodiments, the humid vapor comprises air. Air generally comprises the dry gases that make up the Earth's atmosphere, but air also typically comprises a variable amount of water vapor and/or a plurality of water droplets suspended therein (fog). The amount of water vapor in the air is expressed as relative humidity (RH), which is the ratio of the partial pressure of water vapor to the equilibrium vapor pressure of water at the same temperature. Relative humidity is a function of temperature and the pressure of the environment of interest. The inventive surfaces are suitable for use in environments having any level of relative humidity, up to and including 100% relative humidity.

Figure 10:
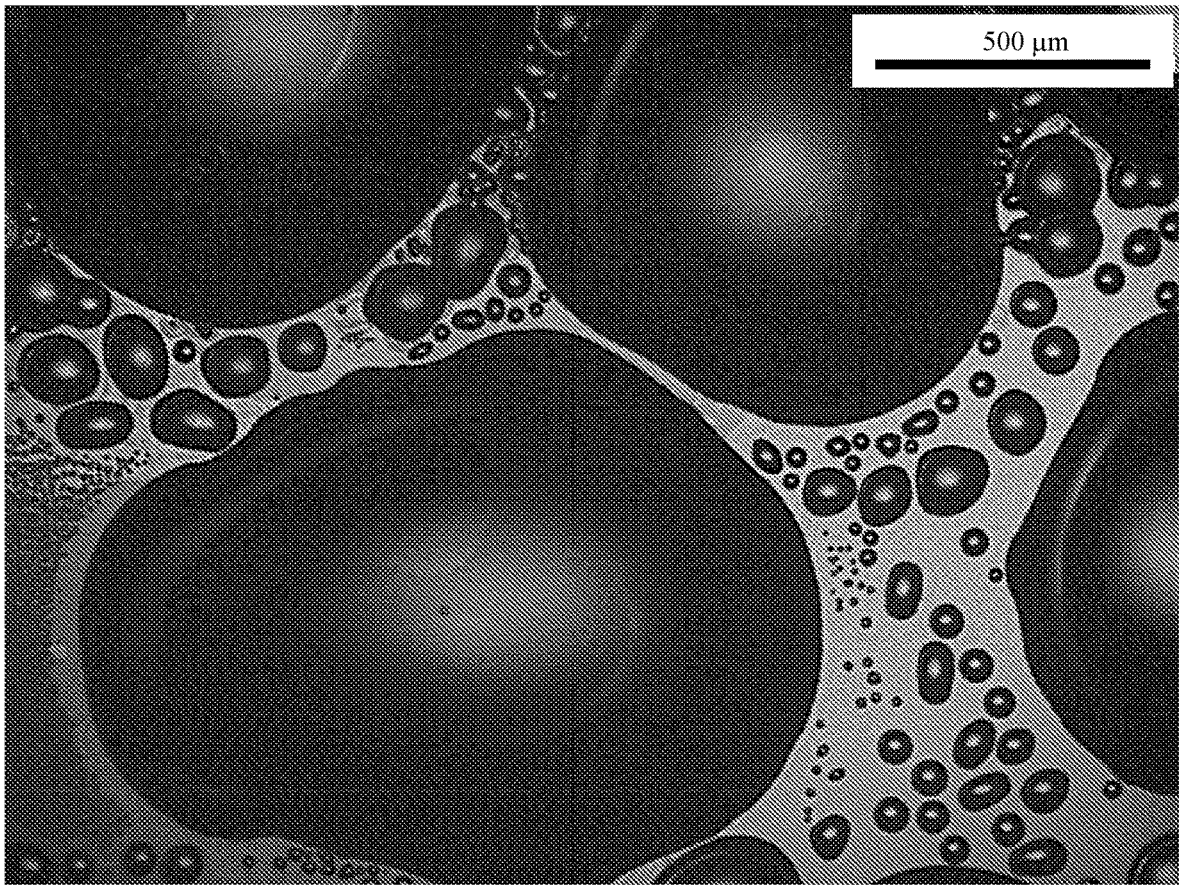
FIG. 10 is a microscopic image showing the water droplets collected after 60 minutes on a nanoporous surface in accordance with the present invention.
Figure 11:
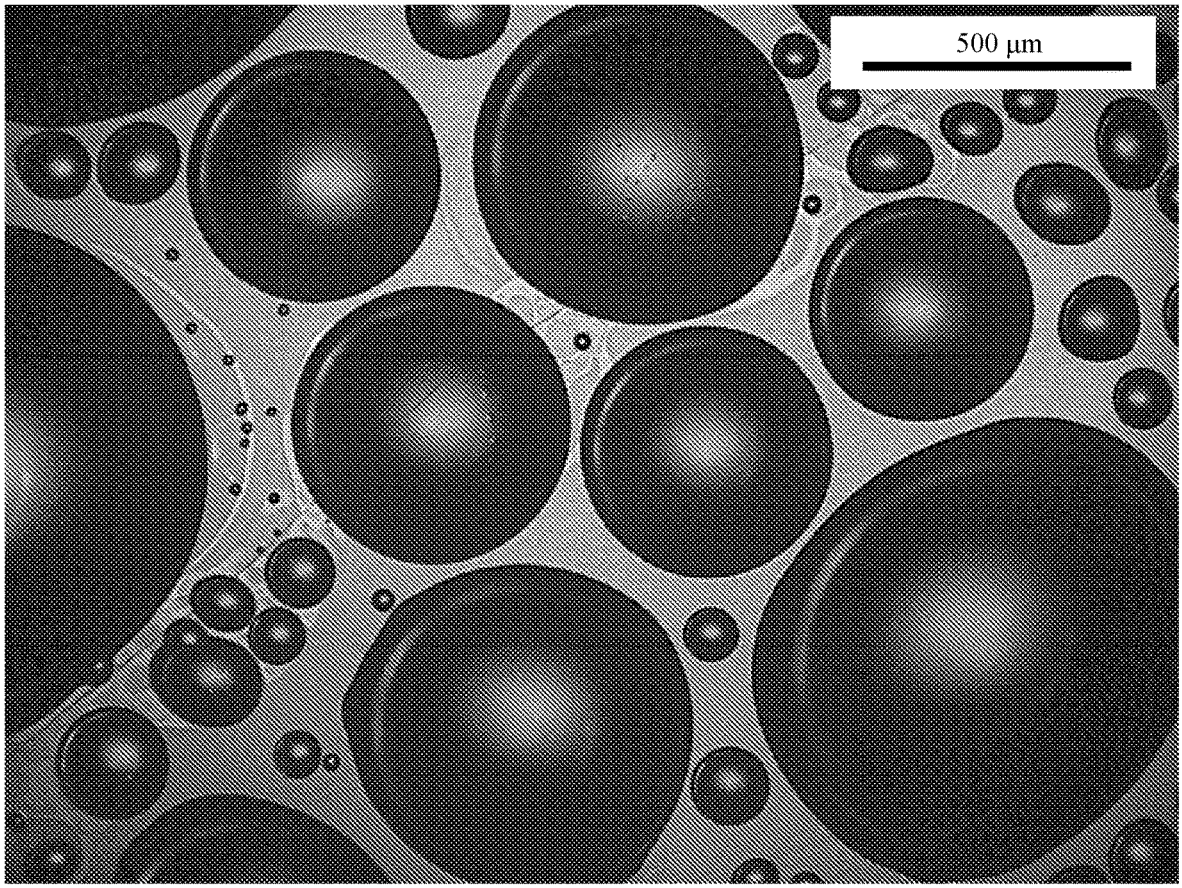
FIG. 11 is a microscopic image showing water droplets collected after 60 minutes on a plain, flat (photoresist) surface under the same conditions as in FIG. 10.

As the inventive surfaces allow for asymmetrical coalescence of droplets and encourage nucleation of new droplets, in certain embodiments the surfaces are particularly suitable for recovering water from a humid vapor, such as air or the evaporate from a cooling tower. Methods of recovering water from the humid vapor comprise contacting the surface with the vapor. This contacting causes water droplets to nucleate on the surface. In order for water from the vapor to nucleate on the surface, the surface temperature should be less than the dew point of the vapor. When the droplets nucleate on the surface, they contact an inner portion of one or more of the recessed areas formed in the surface (see, FIG. 1), thereby pinning the water droplet to the recessed area(s) due to the capillary pressure caused by the recessed area(s). The pinning effect of the surface causes asymmetrical droplets to form, since the energy required to overcome the capillary pressure is greater than the potential surface energy reduction caused by symmetrical, spherical coalescing of the droplets. After the droplets are recovered from the surface, small amounts of water may remain trapped in the recessed areas. This trapped water seeds new nucleation of droplets. Over time, the increased nucleation leads to more and larger droplets formed on the surface and eventually recovered. The unique geometries of the inventive surfaces allows a greater portion of the surface to collect water droplets (as compared to prior art surfaces), through the formation of larger (more surface area coverage) droplets and the formation of a greater number of total droplets. FIGS. 10 and 11 show the increased surface area coverage provided by the inventive surfaces (FIG. 10) as compared to a plain, photoresist-covered surface (FIG. 11). In order to maximize water recovery, the surface temperature should generally be greater than the frost point of the vapor, thereby preventing freezing of the droplets. However, it is also acceptable for water recovery applications that the surface temperature falls below the frost point of the vapor for some period of time, so long as the droplets do not freeze and remain frozen on the surface for extended periods of time. The water droplets can be recovered from the surfaces through a variety of techniques. For example, the droplets can be removed and recovered from the surfaces through standard shedding due to gravity. In certain embodiments, mechanically-assisted shedding techniques, such as mechanical vibrations or tapping and/or directed air-flow, may be used to increase water recover rate.

Droplet behaviors on the inventive surfaces of the present invention also make the surfaces particularly useful in controlling the behavior of frost formation. Therefore, in one or more embodiments, the inventive surfaces can be used in a method of forming frost on the surfaces. Similar to the water recovery methods above, the frost formation comprises contacting the nanopatterned surface with a humid vapor, such as air. In order for the frost layer to form, however, the surface temperature must be less than the frost point of the air. The contacting first causes small water droplets to nucleate on the surface due to vaporized water or suspended droplets present in the air or other humid vapor. As discussed above, the water droplets remain pinned in place (to the pores or pillars) on the surface due to the capillary pressure caused by the recessed areas. As symmetrical, spherical coalescence of droplets has been shown to mitigate frost formation, the hindrance of coalescence on the inventive surfaces has the opposite effect. This is because the enthalpies favor freezing of the smaller and asymmetrical droplets instead of coalescing, and thus the smaller and asymmetrical droplets will freeze more quickly than larger, spherical droplets. Thus, the droplets formed on the inventive surfaces show accelerated frost formation (i.e., the water droplets freeze more quickly to form a frost layer on the inventive surfaces than on prior art surfaces). Accelerated frost formation on the inventive surfaces is particularly apparent over conventional surfaces in environments having low relative humidity. Therefore, in particularly preferred embodiments, the humid vapor or air has a relative humidity of less than about 75%, preferably less than about 60%, more preferably less than about 40%, and even more preferably less than about 30%. However, it should be understood that the inventive surfaces are advantageous and useful in environments having any level of relative humidity. Advantageously, in certain embodiments, the inventive surfaces facilitate the formation of cubic ice crystals at less extreme temperatures and pressures compared to prior art surfaces. Therefore, frost layers formed on the inventive surfaces generally have decreased thickness compared to frost layers formed on prior art surfaces. For example, in certain embodiments, the frost layer has a thickness of less than about 1 mm, preferably less than about 0.5 mm, and more preferably about 0.3 mm or less. Without being bound by any theory, it is believed that the accelerated from formation leads to a frost layer having increased density (due to the cubic ice structure) and thus decreased thickness.

Figure 12:
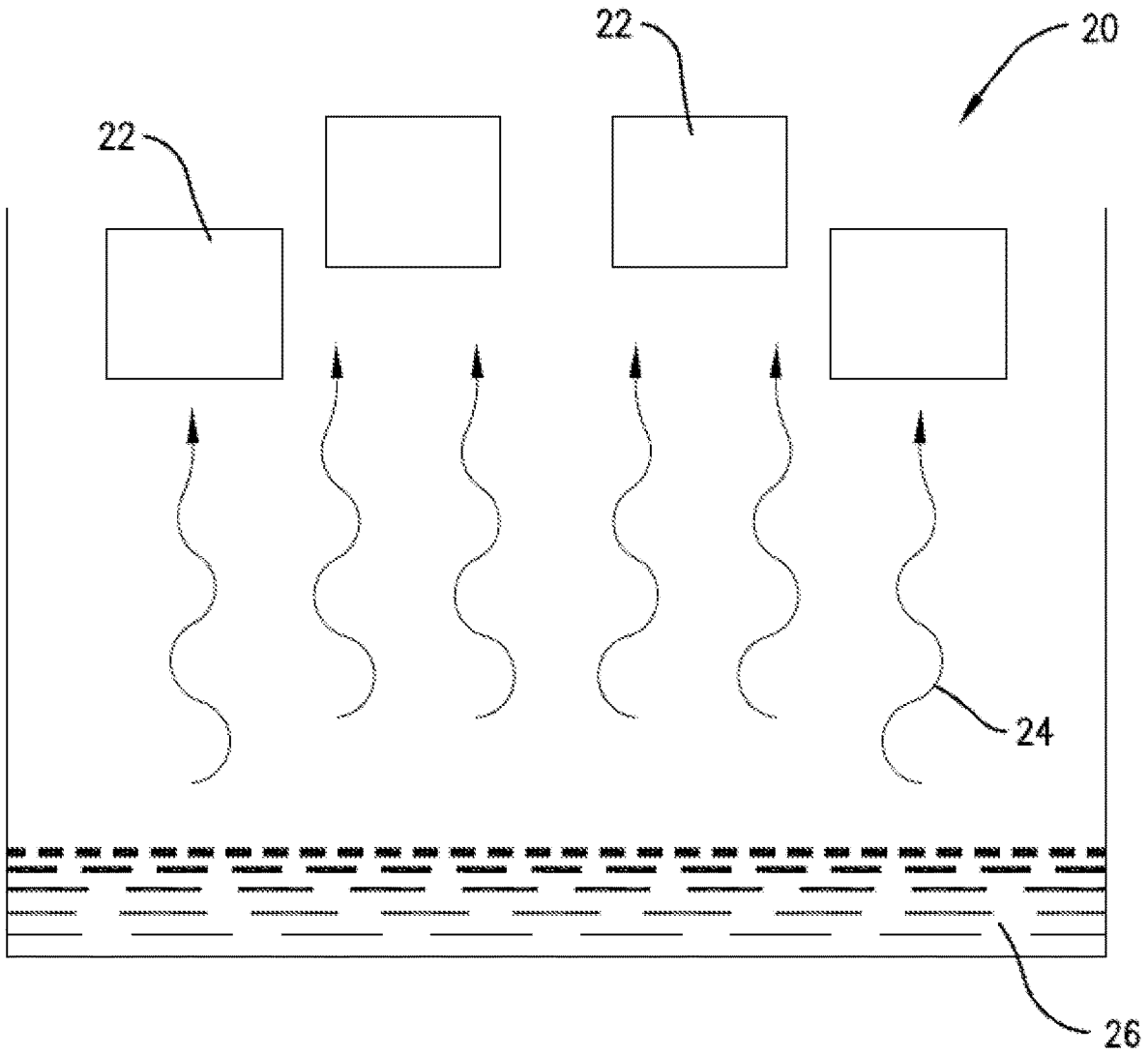
FIG. 12 is a profile, schematic depiction of a cooling tower equipped with condensing units comprising nanoporous surfaces in accordance with the present invention.

The inventive surfaces and methods can be used in a variety of industries that may desire improved water recovery or frost control. For example, the inventive surfaces may be used in fog harvesting applications to collect and condense water droplets suspended in the air. Prior art fog harvesting techniques generally use mesh screens to encourage coalescence. However, water recovery using such techniques is hindered by limitations in droplet formation and coalescence on the mesh screens and by losses due to re-suspension of droplets caused by wind. The surfaces of the present invention advantageously provide increased water collection over prior art techniques by providing favorable nucleation points on the surface from droplet "seeds" that remain pinned to the recessed areas after droplet shedding and by discouraging losses due to wind blowing through the surfaces. In a similar manner, the inventive surfaces can be used to recover water from evaporative cooling towers, such as the type shown schematically in FIG. 12. Losses from evaporate to the atmosphere account for a substantial portion of the overall water losses in the cooling tower systems, which requires large amounts of make-up water to replace. Thus, a cooling tower 20 may be configured with one or more evaporate condensing units 22 positioned to contact an evaporate 24 and recover a portion of the water 26 that would otherwise be lost. The condensing units may comprise outer surface and a cold fluid stream inside the unit which reduces the temperature of the outer surface, thereby encouraging condensing of the evaporate on the surface. The inventive surfaces are particularly suitable for use on the outer surfaces of condensing units used for evaporate recovery.

The inventive surfaces can also be used to mitigate the negative impact of frost in heat systems utilizing heat exchange, such as refrigeration and air-conditioning systems. For example, the inventive surfaces may be used as an outer surface of a heat exchange conduit. The outer surface may comprise one or more fins extended therefrom to increase the rate of heat transfer in the system. The heat exchange conduit may be configured such that a coolant fluid flows through the conduit, contacting the inner surface of the conduit and lowering the temperature of the outer surface below the freeze point of vapor in the surrounding environment. In certain such systems, frost formation is unavoidable, and thus the inventive surfaces may be used as the outer surface of the conduit in order to control the freezing behavior. The surfaces can also be used in applications requiring extremely low temperatures, such as cryo-electron microscopy and cryogenics. Additionally, the cubic ice structures formed using the inventive surfaces are generally transparent and therefore may be useful in microscopy applications.

EXAMPLES

The following examples set forth the creation and performance testing of inventive surfaces in accordance with embodiments of the present invention. It is to be understood, however, that these examples are provided by way of illustration and nothing therein should be taken as a limitation upon the overall scope of the invention.

Example I

Creation of Nanoporous Surfaces

Figure 13A:
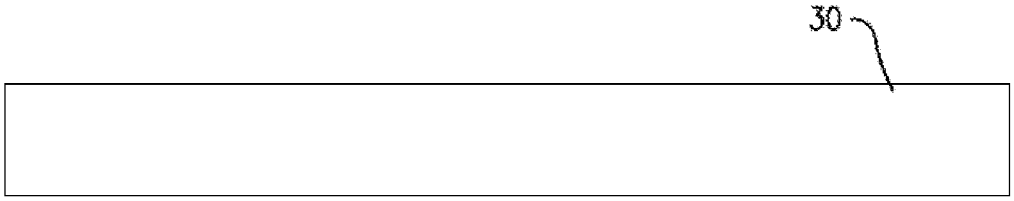
FIGS. 13A-13D are drawings showing an exemplary process of forming a nanoporous surface using photolithography in accordance with the present invention.
Figure 13B:
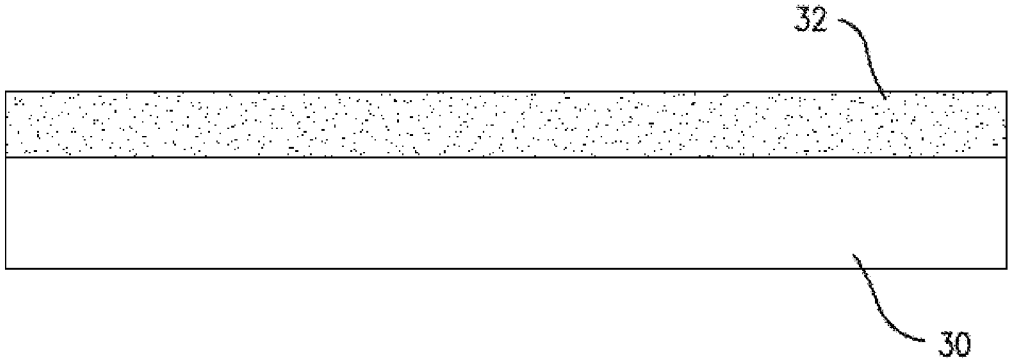
Figure 13C:
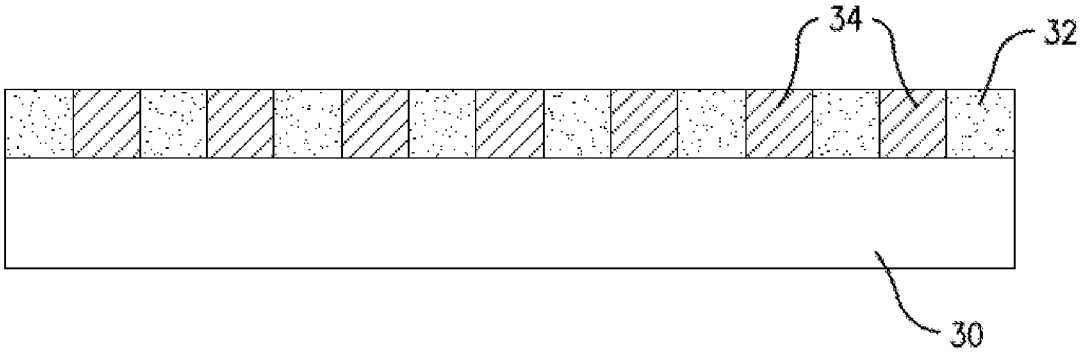
Figure 13D:
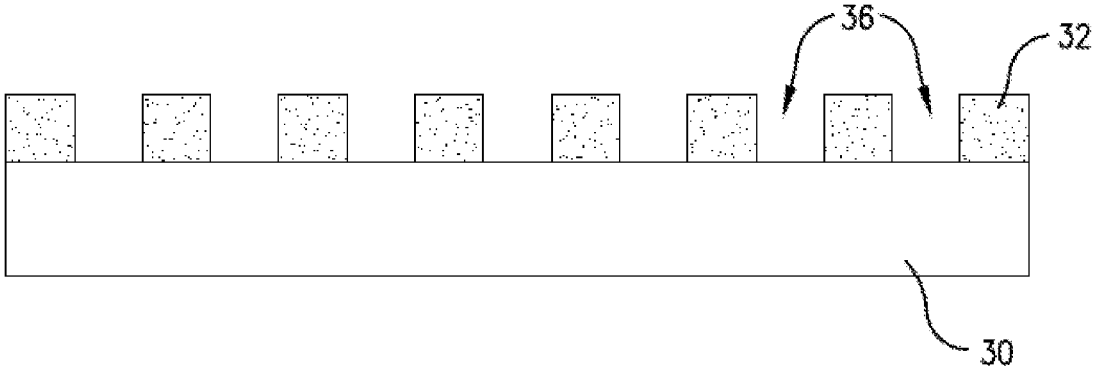

Nanoporous surfaces were created from a photosensitive polymer using lithographic processing known in the art, whereby portions of the polymer layer were selectively removed to create voids in the layer, as shown in FIGS. 13A-13D. First, a clean silicon wafer 30 was provided (FIG. 13A). Second, a photosensitive polymer 32 was spun onto the wafer and crosslinked (FIG. 13B). Third, the photosensitive polymer was selectively exposed to light, creating regions 34 where the polymer was no longer crosslinked (FIG. 13C). Finally, the entire stack was placed into developer, which removed the polymer chains that were not crosslinked, thereby creating regularly patterned nanopores 36 (FIG. 13D). The depths of the pores were determined by measuring the height of the spun photoresist layer and were typically around 1 micron in height (depth). The diameters of the pores were determined by the light exposure time during the photolithography process. The actual diameter for the pores on the manufactured surfaces varied between 500-750 nm.

Example II

Water Collection Testing

Figure 14:
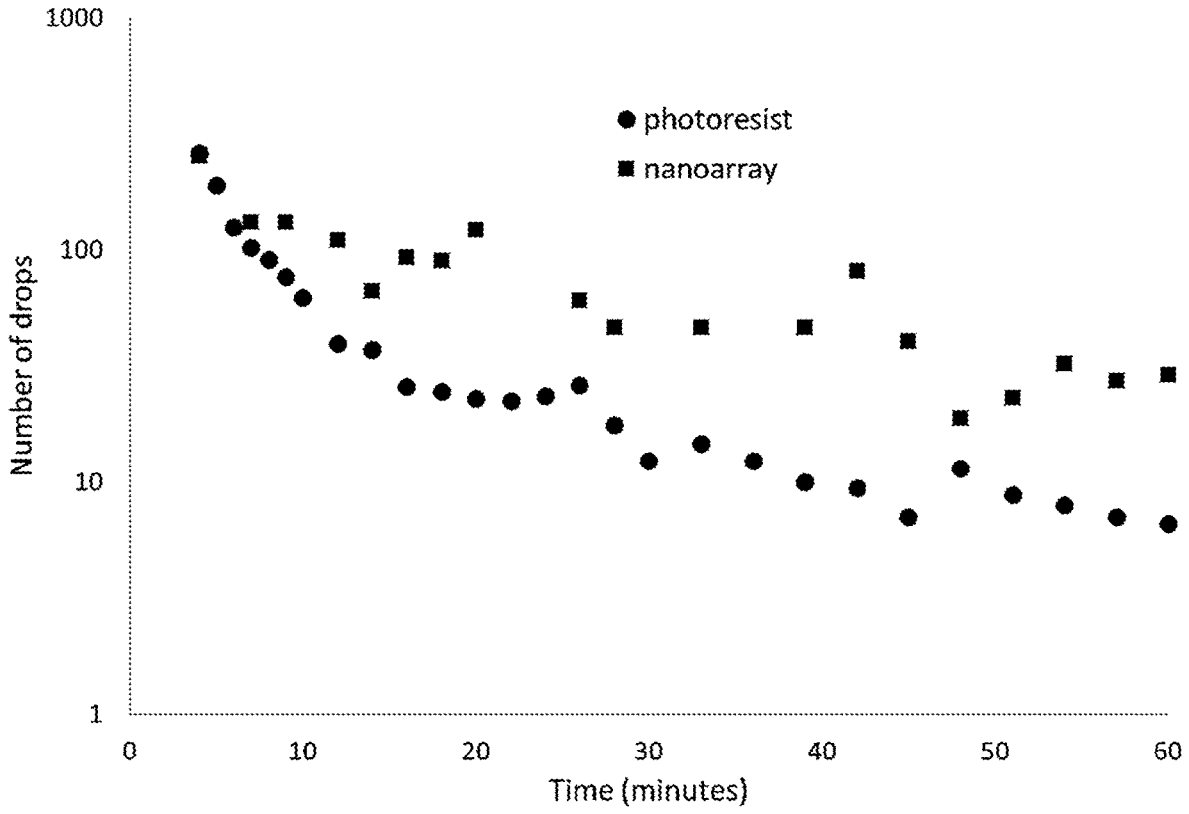
FIG. 14 is a graph plotting the number of droplets on the nanoporous (nanoarray) versus photoresist surfaces over time as a function of time.

Testing was performed to determine whether surfaces with nanosized pores prevent droplet coalescence and promote nucleation as compared to surfaces coated with plain, flat photoresist coatings. The surfaces were maintain at 10° C. and the air temperature was 25° C. and 60% RH. FIG. 14 shows the number of droplets on the nanopatterned (nanoarray) versus plain photoresist surfaces over time. The results show that at surface temperatures above the freezing temperature and below air dew point temperature, nanopatterned surfaces increase the total amount of water on a surface over time. It is believed this is due to increased nucleation. After nucleation, the number of droplets decreased due to coalescence and direct droplet growth. The number of droplets then increased again as more droplets nucleated in the voids caused by coalescence. On the nanopatterned surface, the rate of coalescence was much lower, but the frequency and number of new droplet created was greater. As shown in the graph of FIG. 14, after 60 minutes the increase of nucleation led to significantly more water on the nanopatterned surface. There were more droplets, significantly larger droplets, and more surface area covered on the nanopatterned surface (See FIGS. 10 and 11). The nanopatterned surface could be useful in water or fog collection applications, and the surface could be combined with surface vibration, surface shaking, manual droplet removal, droplet removal by high air flow rates, and the like, in order to remove and collect nucleated water from the surface.

Example III

Freezing Rate Testing

Freeze time tests were performed to evaluate the accelerated frost-forming potential of the inventive surfaces compared to other surfaces at different relative humidity. The frost layers on certain surfaces were also measured to compare potential frost layer densities. For these tests, the air temperature was maintained at 25° C. and surface temperature was −8° C.±1° C. Freezing behavior on the nanoporous (pore diameter of about 500 to about 750 nm and depth of about 1 um) and nanopillared (pillar diameters of about 0.7 to about 1 um with a spacing of about 0.3 um) surfaces differed significantly from a plain, flat hydrophilic (silicon) surface and a plain, flat photoresist-coated surface, as shown in Table 1, below.

TABLE 1

Freezing time, droplet size, and final frost height.

| Surface | Relative humidity | Time to freezing (min) | Number of droplets per $mm^2$ | Size of droplets (μm) | Final height (mm) |
|---|---|---|---|---|---|
| Hydrophilic | 30% | 19 | 40 | 300 | — |
| Photoresist | | 7 | 500 | 50 | — |
| Nanoporous | | 5 | 1250 | 20 | — |
| Hydrophilic | 40% | 7.2 | 200 | 50 | 1.0 |
| Photoresist | | — | — | — | 0.8 |
| Nanoporous | | 3.7 | 150 | 30 | 0.2 |
| Nanopillared | | 1.22 | — | — | — |
| Hydrophilic | 60% | 5.2 | 170 | 100 | 1.7 |
| Photoresist | | — | — | — | — |
| Nanoporous | | 5 | 235 | 40 | 0.3 |
| Nanopillared | | 0.58 | — | 10 | — |

At each relative humidity, the nanopatterned surfaces froze faster than the plain hydrophilic and photoresist surfaces, and this was most pronounced at lower humidities. The results in Table 1 were due to the droplets being pinned or "stuck" in the nanopores or in the space between the nanopillars on the nanopatterned surfaces and thus being unable to overcome the capillary pressure required to move. It was believed that droplet pinning limits droplet mobility on the nanopatterned surfaces, and droplets are much less likely to coalesce (merge) with neighboring droplets compared to the other surfaces. This was confirmed through observation of droplets on the nanopatterned surfaces, which had the smallest droplets at freezing (compared to other surfaces). These measurements were taken for quiescent (low velocity) flows, but it is expected that a similar trend would occur for external flows because droplet nucleation and coalescence are important mechanisms. As a result of freezing faster, it was expected that the frost on the nanopatterned surfaces would be denser, resulting in a lower thermal resistance of the frost and lower impedance to heat transfer.

Frost Structure Observations

Figure 15:
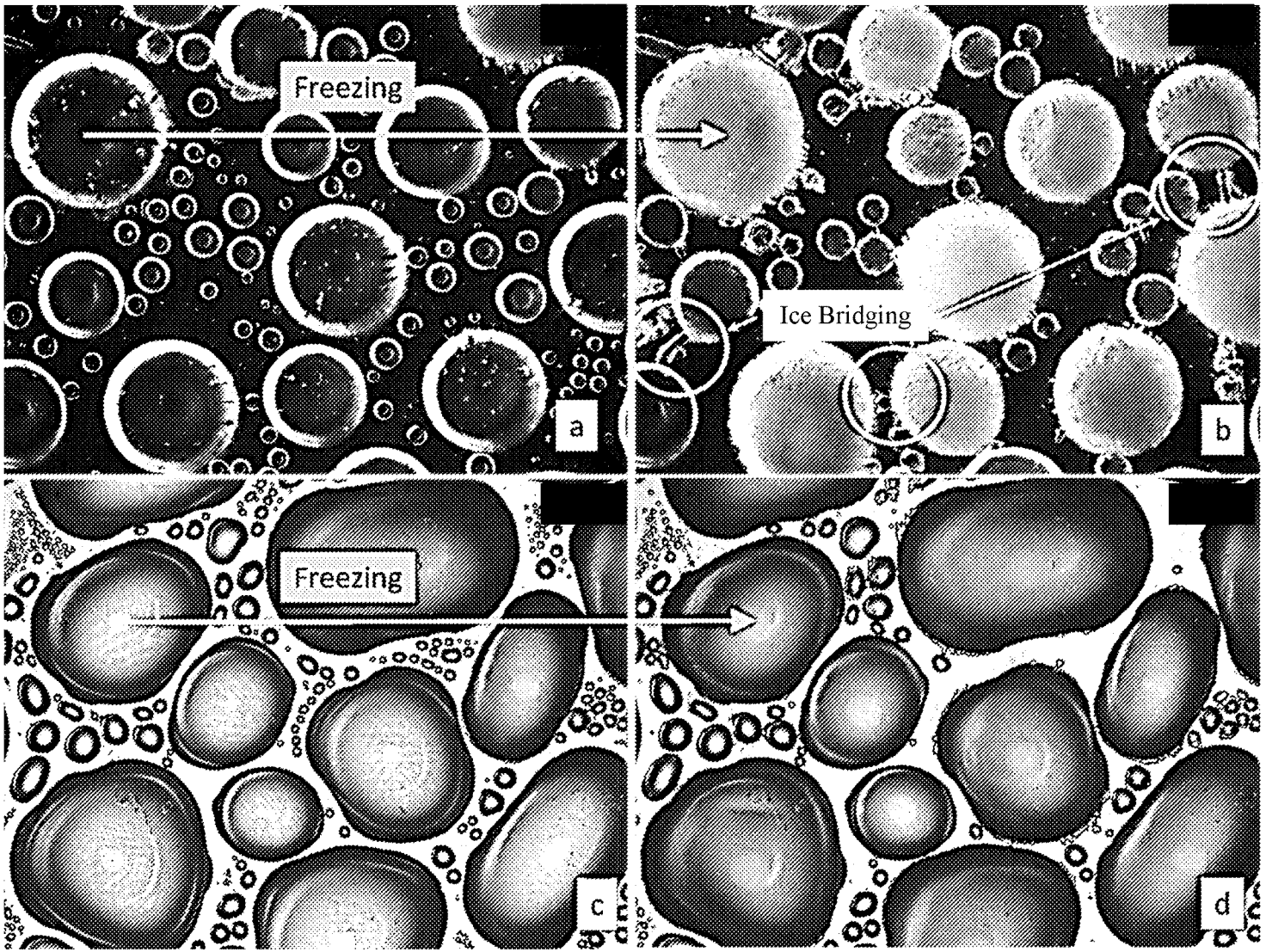
FIG. 15 is a series of microscopic images showing droplets on a hydrophilic surface before (a) and after freezing (b) compared to a nanoporous surface in accordance with the present invention before (c) and after (d) freezing, wherein each image is 765×574 microns.

To obtain a better understanding of the freezing behavior on the nanopatterned surfaces, the structures of the frost layers were examined. On the plain hydrophilic surface, there was a clear freezing front propagation, and ice bridging was observed as the main mechanism for the freezing front propagation, as shown in FIG. 15 photos (a) and (b). On the nanoporous surface, the freezing front was more difficult to track, as shown in FIG. 15 photos (c) and (d). During several tests, all droplets in the field of view froze in a single frame or random patterning of frost was observed. At 40% humidity, the freezing front propagation on the plain hydrophilic surface was 0.73 mm/min. Where the freezing front was distinguishable on the nanoporous sample, the propagation was 5.2 mm/min. Additionally, when the droplets froze on the nanoporous surfaces, there was very little change in the index of refraction or reflectance. The patterns beneath the droplets were still faintly visible through the ice nuclei. During all the plain hydrophilic surface test, however, the water droplet changed from a clear or soft white to an opaque bright white color. On the plain hydrophilic surface, there was also a measurable increase in the size of the droplets when freezing occurs, and grain boundaries and dislocations were visible within the ice nuclei. This increase in diameter of the droplets on the plain hydrophilic surface is consistent with the decrease in density associated with the transition from liquid to solid in water.

Figure 16:
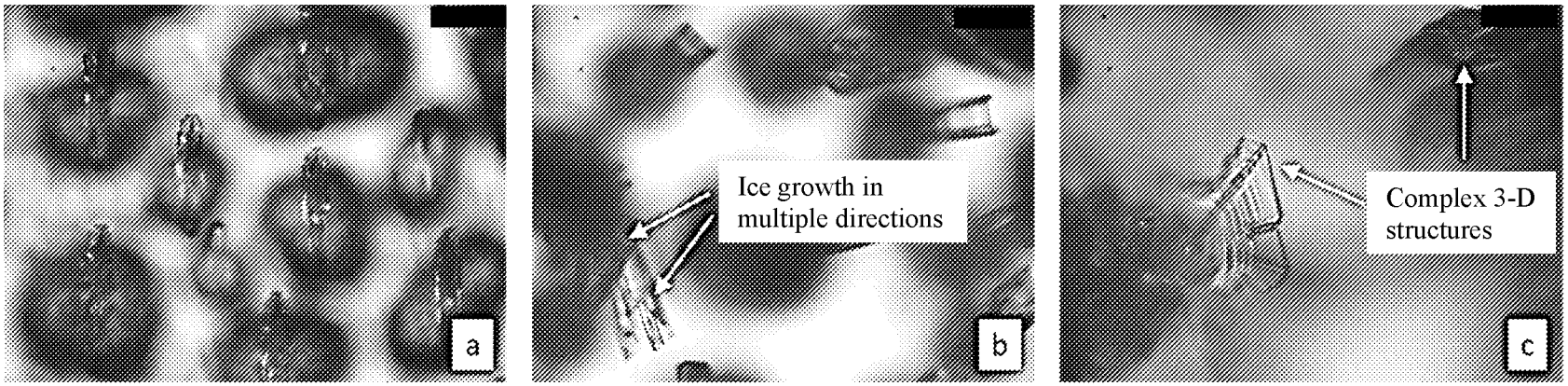
FIG. 16 is a series of microscopic images showing the beginning of the tip growth process from the ice nuclei on the nanoporous surface (a), compared to the tip growth process on the hydrophilic surface (b), and the formation three dimensional structures on the hydrophilic surface (c), wherein each images is 765×574 microns.
Figure 17A:
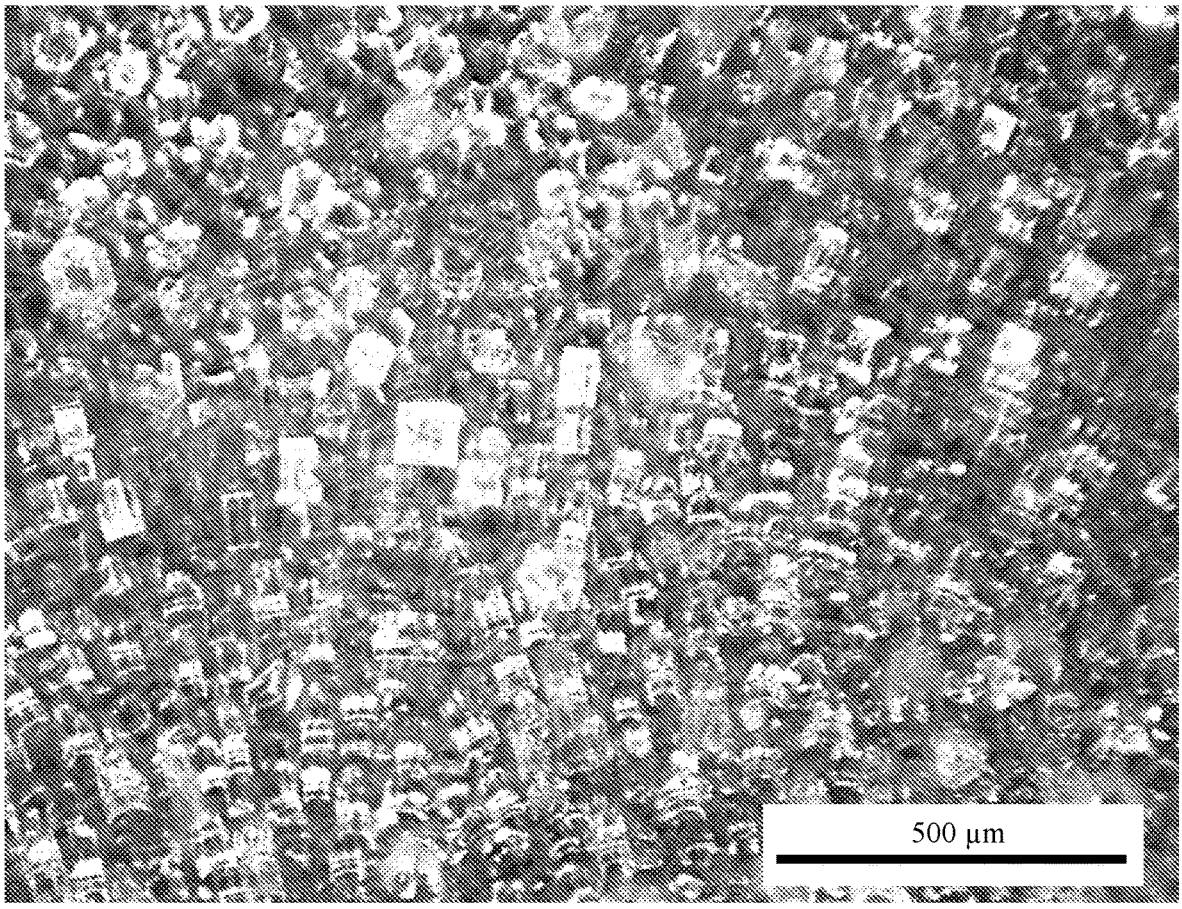
Figure 17B:
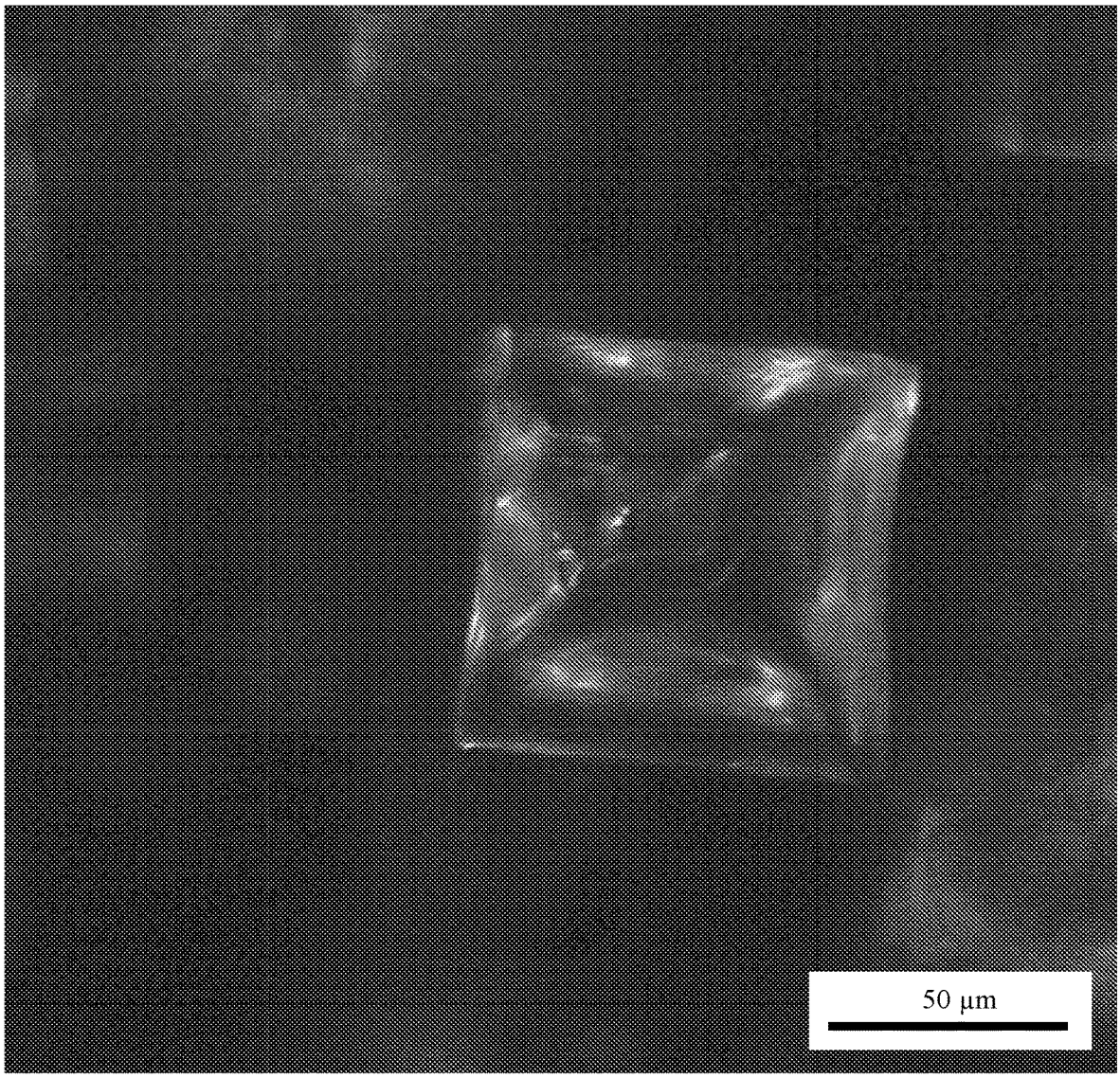

On the plain hydrophilic surfaces, one dimensional growth was initially observed, which began from the top on the ice nuclei. After several minutes, the ice dendrites began to grow in different directions, and complex three dimension structures emerged. The hexagonal structure of ice became apparent, and strongly resembled snowflakes, trees, and feathers. This type of frost growth is understood in the art and expected on prior art surfaces, such as plain, flat hydrophilic surfaces, as shown in FIG. 16. On the nanoporous surface, cubic ice crystals predominately grew, as shown in FIGS. 17A and 17B. Although the hexagonal structure of ice was also seen, it usually formed near the edges of the nanopatterning. The cubic ice structure typically only grew in one dimension and dendritic formation was suppressed. The cubic ice structure was very reflective of light, (see FIG. 17A), as would be expected on a crystalline structure. Amorphous ice tends to form or change into cubic ice as surrounding conditions change. The combination of cubic ice forming from the ice nuclei, the lack of index of refraction change, and lack of volume change upon freezing are evidence that ice nuclei on the nanoporous surfaces were composed of amorphous ice. The creation of amorphous ice typically requires pressures in excess 1 GPa or temperatures below 170 K, yet the nanoporous surfaces achieved this structure at much higher temperatures and atmospheric pressure. Although small amounts of cubic ice can sometimes be caused by salt impurities on surfaces, the cubic crystals in this experiment grew over large areas of (multiple square millimeters of surface area coverage) and on multiple nanopatterned surfaces. Additionally, the nanopores were made in a polymer, making impurities from salt very unlikely.

Figure 18:
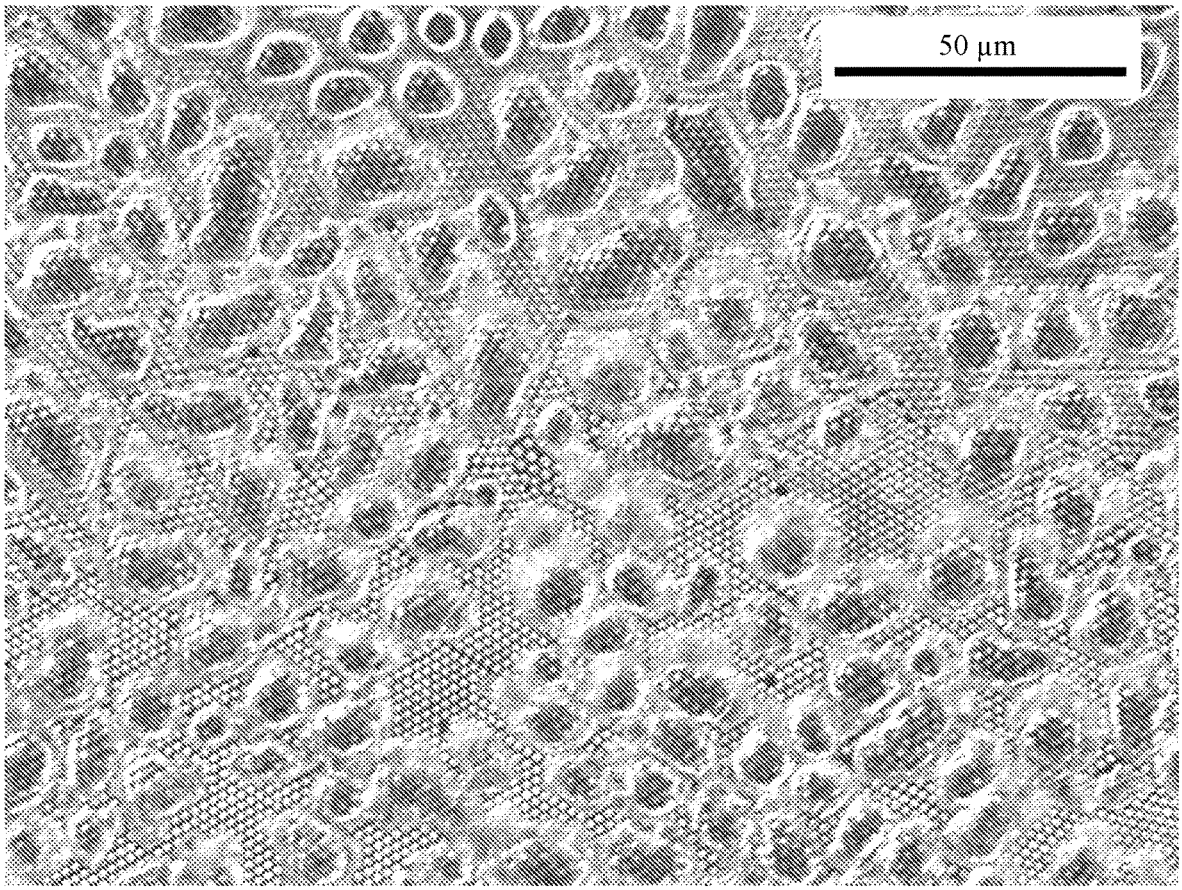
FIG. 18 is a microscopic image of frozen droplets on a nanopillared surface in accordance with the present invention.

As shown in FIG. 18, the frozen water droplets on the nanopillared surfaces can coalesce into asymmetric patterns, similar to water droplets frozen on the nanoporous surfaces.

As evidenced by the experiments above, the nanopatterned surfaces demonstrated the ability to change crystalline structures. Different structures were also seen growing in close proximity to each other. The testing showed that both the cubic and hexagonal structures of ice grow on a patterned surface. The ability to change crystal structures could be important for a wide range of applications, including manufacturing and optics.

The invention claimed is:

1. A surface for enhancing the condensation and/or accelerating freezing of water on said surface, said surface comprising:

a substrate adapted to contact a vapor and cause a plurality of asymmetrically-shaped water droplets to form thereon, wherein the substrate comprises a plurality of recessed areas formed therein, each of said recessed areas having an average longest lateral dimension of 100 nm to 10 μm and an average depth of 150 nm to 30 μm, said recessed areas being adapted to restrict the mobility of said droplets upon said surface by contacting said droplets with an inner portion of one or more of said plurality of recessed areas, thereby pinning said droplets to said recessed areas and inhibiting formation of symmetrical droplets through droplet coalescence upon said surface, wherein said surface is hydrophilic or biphilic such that said surface has a contact angle with said water droplets of equal to or less than 90°.

2. The surface of claim 1, wherein said plurality of recessed areas are pores formed in the substrate.

3. The surface of claim 2, wherein said plurality of pores are formed in said substrate at a density of 10,000 to 1,000,000 pores/mm$^2$.

4. The surface of claim 1, wherein said plurality of recessed areas are interstitial spaces between a plurality of pillar structures.

5. The surface of claim 4, wherein said plurality of pillar structures comprises cylinders having an average diameter of 100 nm to 30 μm.

6. The surface of claim 1, wherein said substrate comprises one or more layers deposited upon a base material.

7. The surface of claim 6, wherein said one or more layers comprises a layer selected from the group consisting of silica layers, photosensitive polymer layers, non-photosensitive polymer layers, and resinous coating layers.

8. The surface of claim 1, wherein said substrate comprises a material selected from the group consisting of metals (and alloys), polymers, ceramics, composites, and mixtures thereof.

9. The surface of claim 1, wherein said substrate comprises a hydrophilic material.

10. A method of forming frost on the surface of claim 1, said method comprising: contacting humid air with said surface, said surface having a surface temperature less than the frost point of the air, thereby causing one or more asymmetrical water droplets to form on said surface having a contact angle of equal to or less than 900, wherein upon forming, said one or more asymmetrical water droplets contact an inner portion of one or more of said plurality of recessed areas, thereby pinning said one or more asymmetrical droplets to the one or more recessed areas; and freezing said droplets to form a frost layer on said surface.

11. The method of claim 10, wherein said frost layer comprises cubic ice crystals.

12. A heat exchange system comprising one or more conduits configured to conduct a heat-exchange fluid therethrough and having an inner surface configured to contact said heat-exchange fluid and an outer surface comprising the surface of claim 1.

13. The heat exchange system of claim 12, wherein said outer surface comprises one or more fins extended therefrom.

14. A cooling tower comprising one or more evaporate condensing units positioned to contact at least a portion of an evaporate, said one or more condensing units having one or more surfaces according to claim 1.

15. A method of recovering water from a humid vapor comprising contacting said humid vapor with a hydrophilic or biphilic surface comprising a plurality of recessed areas, each of said recessed areas having an average longest lateral dimension of 100 nm to 10 μm and an average depth of 150 nm to 30 μm, said surface having a surface temperature less than the dew point of said humid vapor, thereby causing one or more asymmetrical water droplets to form on said surface having a contact angle of equal to or less than 90°, wherein upon forming, said one or more asymmetrical water droplets contact an inner portion of one or more of said plurality of recessed areas, thereby pinning said one or more asymmetrical water droplets to the one or more recessed areas.

16. The method of claim 15, wherein said surface has a surface temperature greater than the frost point of said humid vapor, such that said one or more droplets do not freeze and remain frozen on said surface.

17. The method of claim 15, further comprising recovering at least a portion of said one or more droplets from said surface.

18. The method of claim 17, wherein after said recovering, a portion of said droplets remains attached to an inner portion of one or more of said plurality of recessed areas.

* * * * *